United States Patent [19]

Lekhtman et al.

[11] Patent Number: 4,492,374

[45] Date of Patent: Jan. 8, 1985

[54] SPORTING AND EXERCISING SPRING SHOE

[76] Inventors: David Lekhtman, 5350 Macdonald, Montreal, Quebec; Gregory Lekhtman, 6555 Kildare, Cote St. Luc, Quebec, both of Canada

[21] Appl. No.: 256,100

[22] Filed: Apr. 21, 1981

[51] Int. Cl.[3] ..... A63B 25/10

[52] U.S. Cl. ..... 272/114; 36/7.8; 36/113; 267/28; 267/29; 267/48; 272/DIG. 9

[58] Field of Search ..... 272/70, 114; 36/7.8, 36/113, 114, 115, 116, 129, 132, 27, 81; 280/11.14, 11.19; 267/36 A, 28, 29, 44, 47, 48, 54 R, 55, 160, 158

[56] References Cited

U.S. PATENT DOCUMENTS

| | | | |
|---|---|---|---|
| 577,428 | 2/1897 | Hawes | 267/55 |
| 905,981 | 12/1908 | Blair | 267/28 |
| 921,862 | 5/1909 | Mayhew | 267/29 |
| 996,220 | 6/1911 | Cushman | 267/28 |
| 1,597,792 | 8/1926 | Hoff et al. | 280/11.14 |
| 1,638,350 | 8/1927 | Long | 36/7.8 |
| 1,843,493 | 2/1932 | Pfeifenbring | 36/7.8 |
| 2,168,820 | 8/1939 | Edstrom | 280/11.19 X |
| 2,560,999 | 7/1951 | Unzeitig | 267/29 |
| 3,377,722 | 4/1968 | Downing | 36/7.8 |
| 4,294,023 | 10/1981 | Banford | 36/113 X |

FOREIGN PATENT DOCUMENTS

| | | | |
|---|---|---|---|
| 22288 | 7/1917 | Denmark | 267/48 |
| 472837 | 8/1914 | France | 280/11.14 |
| 1172062 | 11/1969 | United Kingdom | 280/11.19 |

*Primary Examiner*—Richard C. Pinkham
*Assistant Examiner*—Arnold W. Kramer

[57] ABSTRACT

The invention relates to a sporting and exercising unit which includes a foot receiving member and a spring member attached to and disposed at the bottom of the foot receiving member. The spring member includes a spring-leaf-like portion which forms a closed loop and is shaped to permit backward and forward rocking of the user. The spring member may be oval shaped, circle shaped, or in the shape of a parallelogram. The foot receiving member is adjustable to receive different sizes of feet and legs by having opening flaps extending therealong and openings for receiving laces in the flaps whereby to adjust the sizes of these portions by adjusting the sizes of the openings and to adjustably close the openings.

7 Claims, 10 Drawing Figures

FIG. 1
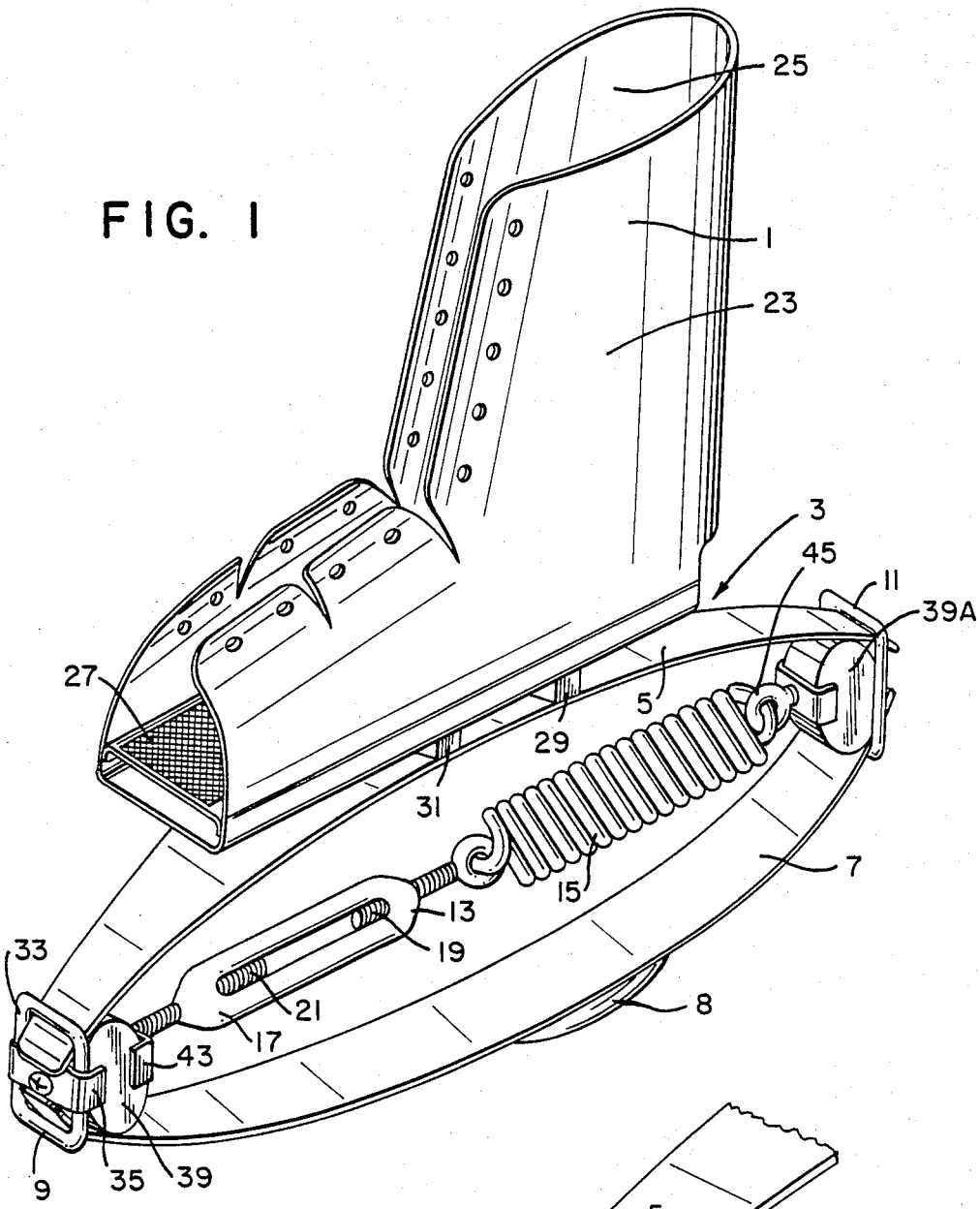
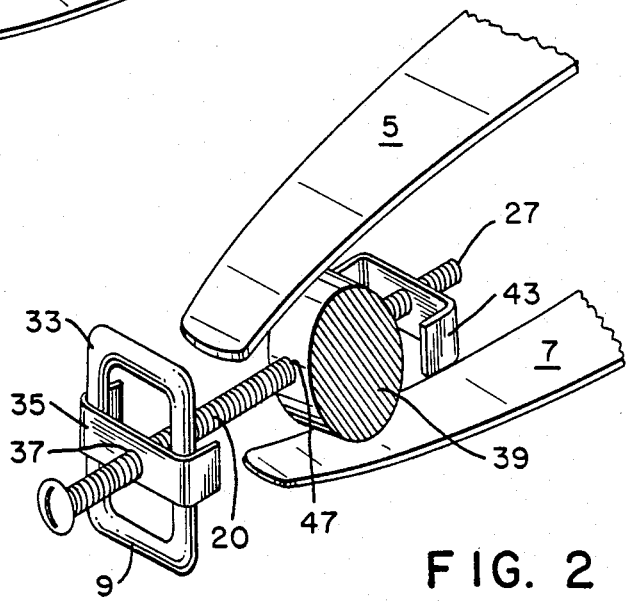
FIG. 2

SPORTING AND EXERCISING SPRING SHOE

BACKGROUND OF THE INVENTION

1. Field of the Invention

The invention relates to a sporting and exercising unit. More specifically, the invention relates to such a unit which includes an adjustable foot receiving member and a spring member attached to and disposed at the bottom of said foot receiving member.

2. Statement of the Prior Art

Sporting and exercise units including a foot receiving portion and an underlying portion are known in the art. These will constitute, for example, roller skates and ice skates. Such units are normally worn on stocking feet. U.S. Pat. No. 4,088,336 illustrates a sporting unit wherein the foot receiving portion is adopted to receive a shoed foot.

U.S. Pat. No. 3,219,358 illustrates a skate with a resilient runner. For this purpose, the skate includes a vertically extending coiled spring between the platform of the skate and the blade.

U.S. Pat. No. 2,172,000 teaches a jumper which includes a foot receiving portion and a spring member disposed at the bottom of the foot receiving portion. The foot receiving portion is adapted to receive a shoed foot. However, the spring member does not constitute a closed loop, nor is the spring member shaped to permit backward and forward rocking of the user.

SUMMARY OF THE INVENTION

It is therefore an object of the invention to provide a sporting and exercising unit of the above-described character wherein the spring member comprises a spring-leaf-like portion forming a closed loop and being shaped to permit backward and forward rocking of the user.

It is a further object of the invention to provide a foot receiving member for use with such a sporting and exercising unit which is adjustable to receive different sizes of feet and legs.

In accordance with the invention, a sporting and exercising unit comprises: a foot receiving member; a spring member attached to and disposed at the bottom of said foot receiving member; said spring member comprising a spring-leaf-like portion forming a closed loop and shaped to permit backward and forward rocking of a user.

From a different aspect, and in accordance with the invention, a boot for use with such a sporting and exercising unit comprises: a foot receiving portion; a leg-embracing portion; said portions being adjustable to receive different sizes of feet and legs.

BRIEF DESCRIPTION OF THE DRAWINGS

The invention will be better understood by an examination of the following description, together with the accompanying drawings, in which:

FIG. 1 is a perspective view of one embodiment of a unit in accordance with the invention;

FIG. 2 illustrates, in greater detail, the joining arrangement at the ends of the flexible members.

DESCRIPTION OF PREFERRED EMBODIMENTS

Figure 3A:
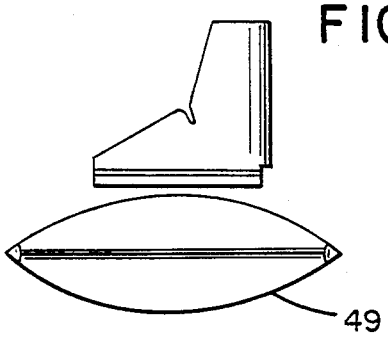
FIGS. 3A–3H illustrate further embodiments of the invention.
Figure 3B:
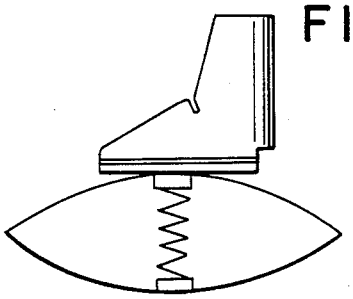
Figure 3C:
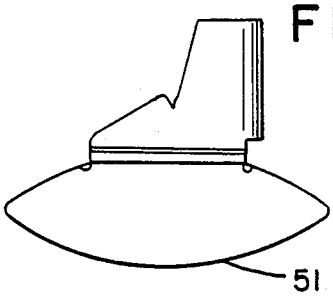

FIG. 1 shows a single unit in accordance with the invention. As can be seen, the unit in FIG. 1 would be worn on one foot of a user, and a second, similar unit would be worn on the other foot of the user. For this purpose, the unit includes a foot receiving member 1 which will be described in greater detail below.

The unit also includes a spring member 3 which is made up of a spring-leaf-like portion. In FIG. 1, this portion comprises layers 5 and 7 of a flexible material such as a flexible metallic material or a hard flexible plastic material. Other embodiments of the spring-leaf-like portion are illustrated in FIG. 3.

The flexible layers 5 and 7 are joined together at ends 9 and 11, and are separated between the ends. Thus, the arrangement of the layers 5 and 7 and the joinings 9 and 11 combine to form a member having spring-leaf-like characteristics. The joints at the ends of the layers will be more fully described below.

Disposed on the bottom of the layer 7 is a rubber protrusion 8 which is shaped somewhat in the form of a half-oval. The protrusion is placed centrally on the flexible layer 7 and permits easier rocking by a user as will be discussed below.

The unit shown in FIG. 1 also includes a spring rate and weight adjustment mechanism 13. The unit is intended for use by people in a wide range of heights and weights, and the foot receiving member, as will be seen below, is designed to receive feet of a wide range of sizes, which co-relates with people of a wide range of heights. The mechanism 13 adjusts the spring rate of the member 3 to therefore make the unit adaptable to a wide range of weights. By expanding the mechanism, the spring rate of the unit is decreased, i.e., the member 3 becomes springier, or looser, and it is adaptable to receive and be used by heavier people. Of course the opposite is true when the mechanism is contracted. The spring rate can also be adjusted simply to participate in different sports or exercises regardless of the weight of the user.

The mechanism 13 includes a coiled spring 15, an adjusting member 17, and threaded rods 19 and 21. The rods 19 and 21 extend through threaded openings in member 17 so that, when the member 17 is rotated, the rods 19 and 21 will either be drawn together or separated from each other. When 17 is rotated in a clockwise direction, as seen from the front of the unit, the rods will be separated, and they will be drawn together when 15 is rotated in the opposite direction.

When the rods are separated, the spring rate of the spring member 3 is decreased so that the spring is looser, and the unit is capable of accepting heavier people. Or it could be used for exercises or games requiring a looser spring rate.

The foot receiving member 1 includes a leg embracing portion 23 and a foot containing portion 27. As can be seen, both portions contain holes for laces in respective flaps thereof, and a wide range of leg and foot sizes can be accommodated between the fully open state of the flaps and the fully closed state thereof. In operation, the foot and leg of a user are inserted into the member 1 through the openings between respective flaps, and the laces are tightened to the comfort of the user. The laces are then tied so that the unit is retained on the user.

The foot receiving member, or the boot, is designed to be worn over other footwear such as shoes, boots, etc. For this purpose, the boot includes a platform 27 on which the sole of a user's footwear would rest.

Turning now to FIG. 2 of the drawing, it can be seen that the joint at end 9 of spring member 3 comprises a ring member 33 having a bar 35 extending thereacross. The bar 35 has a central opening 37. A circular rubber member 39 is disposed between the layers 5 and 7, and a second bar 43 is disposed on the other side of member 39. Although not shown in the drawing, the bar 43 will include a central opening similar to opening 37.

Opening 47 extends through the member 39 to emerge at the other side thereof in alignment with the opening in the bar 43, and opening 37 will be disposed in alignment with opening 47, so that an opening extends in alignment through bar 37, member 39 and bar 43.

Screw 20, whose right hand end constitutes rod 21, is adapted to extend through the last mentioned opening into the left hand opening of adjusting member 17. To assemble the joint, the member 39 is disposed between layers 5 and 7 so that the openings therefore are located centrally between the layers. Bar 43 is disposed on the member 39 such that its opening is in alignment with the opening on the right hand side of the member 39. Ring 33 is moved towards the member 39 until bar 35 contacts the member and opening 37 is in alignment with opening 47. At this time, the top of ring 33 will overlie the layer 5 and the bottom of the ring will underlie layer 7. Screw 20 is then inserted through the aligned openings into 17.

The joint at end 11 is the same as the joint at end 9 except that the end of screw 20 has an eyelet 45 at one end thereof for engagement with hook 49 of spring 15. In addition, it is bolted at the outside end of member 39A.

The oval shaped spring member of FIG. 1 constitutes but one embodiment of the invention. Other shapes and arrangements for the spring member are shown in FIGS. 3A to 3H.

Turning to FIG. 3, the embodiment illustrated in 3A is also oval shaped but includes a tension bar 49 instead of coiled spring 15 of FIG. 1. The 3B embodiment includes a coiled spring, but it is oriented in the vertical direction instead of the horizontal. 3C illustrates an embodiment wherein the spring member constitutes a single spring-leaf-like portion 51 forming a closed path with platform 52. The ends of 51 are attached to attachment means at corresponding ends of platform 52.

Figure 3D:
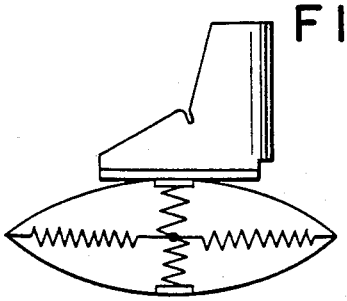
Figure 3E:
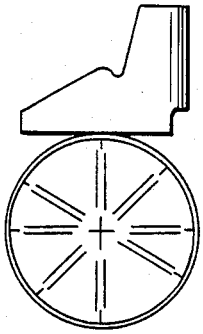
Figure 3F:
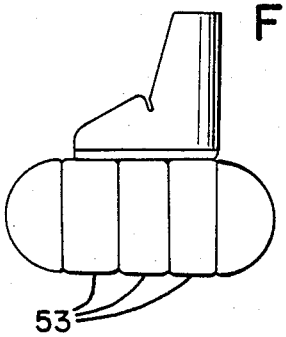
Figure 3G:
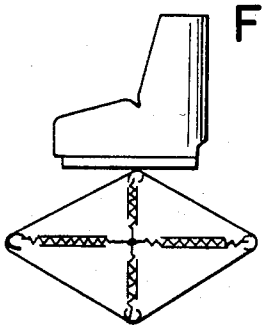

FIG. 3D shows a multiple coiled spring arrangement, and the two springs in this embodiment form a cross by intersecting at their center points and extending in the horizontal and vertical directions respectively. A second multiple spring arrangement is revealed in 3E which includes a single circular spring-leaf-like portion and a plurality of coiled springs extending diametrically across the circle and intersecting at the center of the circle. A somewhat different approach is shown in 3F which includes a plurality of spring boxes 53.

Figure 3H:
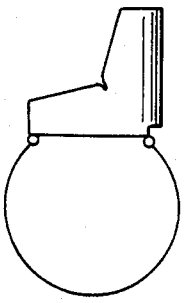

The arrangement in 3G includes four equal sides forcing a parallelogram with crossed springs extending horizontally and vertically within the parallelogram. FIG. 3H is similar to FIG. 3G except that the spring-leaf-like portion is somewhat circular in shape.

As can be seen, the common elements of all embodiments are that the spring-leaf-like portions (spring members), form a closed loop and are shaped to permit forward and backward rocking of a user. The provision of the proturbence 8 improves the apparatus with respect to this activity. The spring-leaf-like portions are formed of a flexible material and may comprise one or more layers of the material to form a closed loop.

In use, the unit can be used for performing exercises such as jogging or running on the spot.

The unit is especially adapted for running because of the shape of the bottom half of the spring member. As is well known, in running, the heel of a runner first makes contact with the ground. In a continuing motion, the remainder of the foot is then placed down on the ground until the toe of the runner makes contact with the ground. Whereupon, the back part of the foot, starting with the heel is raised upwardly.

The somewhat oval-shaped bottom flexible member 7 aids a runner in the running exercise in that the shape of 7 follows the natural path of a foot in the running exercise. It is therefore anticipated, because of the shape of the spring member, and because of the springiness thereof, that a user will be able to attain much higher running speeds than he could attain without the use of the unit.

All of the above is further aided by the inclusion of the protrusion 8 which acts as a pivot in the running process.

The units can also be used in known games, such as basketball and volleyball, as well as games which could be devised taking into account the characteristics of the inventive units.

Although several embodiments have been illustrated, this was for the purpose of describing, but not limiting, the invention. Various modifications, which will come readily to the mind of one skilled in the art, are within the scope of the invention as defined in the appended claims.

I claim:

1. A sporting and exercising unit; comprising:

a foot receiving member;

a spring member attached to and disposed at the bottom of said foot receiving member;

said spring member comprising a spring-leaf-like portion forming a closed loop and shaped to permit backward and forward rocking of a user;

said spring member being shaped to form an oval shape;

said oval being formed from two separate layers, each said layer comprising a flexible material, said layers being joined to each other at the ends thereof;

said layers being joined by separate joints, each said joint comprising;

a ring member having a bar extending centrally thereacross, said bar having an opening extending centrally therethrough;

a circular member having an opening extending diametrically thereacross;

a second bar having an opening extending centrally therethrough;

said circular member being disposed between said layers at a respective end thereof, the opening of said circular member extending centrally of said layers;

said ring being disposed at one end of said layers outwardly of said circular member such that the top part of the ring overlies the top layer and the bottom part of the ring underlies the bottom layer, said bar of said ring abutting said circular member, the opening of said bar of said ring being aligned with the opening in said circular member;

said second bar abutting said circular member on the other side thereof, the opening of said second bar being aligned with the opening of said circular member; and a respective rod member extending through said aligned openings of each respective joint.

2. A unit as defined in claim 1 wherein a coiled spring extends across the length of said oval and is disposed in the center of its width.

3. A unit as defined in claim 2 and further comprising a spring rate and weight adjustment mechanism, said mechanism comprising:

an elongated adjusting member having threaded openings at either end thereof;

one of said rod members being threaded and threadedly extending through one of said openings of said adjusting member;

a second threaded rod member threadedly extending through the other one of said openings of said adjusting member;

said second threaded rod member being attached to one end of said coiled spring at the other end thereof;

the other end of the coiled spring being attached to the other one of said respective rod members.

4. A unit as defined in claim 1 wherein said foot receiving member comprises a foot receiving portion and a leg embracing portion;

both said portions being adjustable to receive different sizes of feet and legs.

5. A unit as defined in claim 4 wherein each of said portions comprises adjacent flap members to define foot and leg openings therebetween;

a plurality of openings extending along said flaps for receiving laces therein;

whereby to adjust the size of said foot and leg portions by adjusting the size of said foot and leg openings.

6. A unit as defined in claim 5 and comprising platform means extending along the bottom of said foot receiving portion.

7. A unit as defined in claim 1 wherein a proturbence is disposed on the outer surface of the bottom one of said flexible layers, said proturbence being centrally disposed on the bottom one of said flexible layer and being somewhat semi-oval shaped.

* * * * *